US006570438B2

(12) United States Patent
Coady

(10) Patent No.: US 6,570,438 B2
(45) Date of Patent: May 27, 2003

(54) PROPORTIONAL TO ABSOLUTE TEMPERATURE REFERENCES WITH REDUCED INPUT SENSITIVITY

(75) Inventor: Edmond Patrick Coady, Colorado Springs, CO (US)

(73) Assignee: Maxim Integrated Products, Inc., Sunnyvale, CA (US)

( * ) Notice: Subject to any disclaimer, the term of this patent is extended or adjusted under 35 U.S.C. 154(b) by 0 days.

(21) Appl. No.: 09/976,766

(22) Filed: Oct. 12, 2001

(65) Prior Publication Data

US 2003/0071680 A1 Apr. 17, 2003

(51) Int. Cl.[7] ..... G05F 1/10
(52) U.S. Cl. ..... 327/539; 327/538; 323/315
(58) Field of Search ..... 327/539, 540, 327/541, 543, 538; 323/312, 315

(56) References Cited

U.S. PATENT DOCUMENTS 3,364,434 A 1/1968 Widlar
3,534,279 A 10/1970 Limberg
4,334,198 A 6/1982 Malchow
4,816,742 A * 3/1989 van de Plassche ..... 323/314
4,879,505 A 11/1989 Barrow et al.
4,888,563 A 12/1989 Stefani
5,015,942 A * 5/1991 Kolanko ..... 323/315
5,113,147 A * 5/1992 Klein ..... 330/253
5,448,174 A * 9/1995 Gose et al. ..... 327/262
5,828,329 A 10/1998 Burns
5,900,772 A * 5/1999 Somerville et al. ..... 327/538
6,198,267 B1 3/2001 Bakker et al.
6,218,822 B1 4/2001 MacQuigg
6,310,510 B1 * 10/2001 Goldman et al. ..... 323/313
6,433,621 B1 * 8/2002 Smith et al. ..... 327/563

* cited by examiner

*Primary Examiner*—Terry D. Cunningham
(74) *Attorney, Agent, or Firm*—Blakely, Sokoloff, Taylor & Zafman LLP

(57) ABSTRACT

Proportional to absolute temperature references having reduced input sensitivity. The references utilize four bipolar transistors, at least one of which is of a different size, coupled to a resistor in a loop, whereby the difference in the VBEs of the transistors appears as a voltage across the resistor. The addition of a further resistor of a selected size in the base circuit of one of the four transistors provides an input variation of an opposite sign to that caused by the finite base currents of the transistors, thereby substantially reducing the input voltage (current) dependence of the proportional to absolute temperature references. Various embodiments are disclosed.

6 Claims, 3 Drawing Sheets

PROPORTIONAL TO ABSOLUTE TEMPERATURE REFERENCES WITH REDUCED INPUT SENSITIVITY

BACKGROUND OF THE INVENTION

1. Field of the Invention

The present invention relates to the field of current and voltage sources and references, and particularly to those that are proportional to absolute temperature 2. Prior Art In general, the base emitter voltage of a junction transistor is given by the equation:

$$V_{BE} = V_{go}\left(1 - \frac{T}{T_0}\right) + V_{BEO}\left(\frac{T}{T_0}\right) + \frac{nKT}{q}\ln\left(\frac{T_0}{T}\right) + \frac{KT}{q}\ln\left(\frac{J_C}{J_{CO}}\right)$$

where:

T=temperature $T_O$=an arbitrary reference or starting temperature $J_C$=the transistor collector current density $J_{CO}$=collector current density for which $V_{BEO}$ was determined $V_{go}$=semiconductor bandgap voltage extrapolated to a temperature of absolute zero $V_{BEO}$=base to emitter voltage V at $T_O$ and $I_{CO}$ q=electron charge n=structure factor K=Boltzmann's constant If one subtracts the VBEs of two transistors a and b operating with different current densities, such as two identical transistors a and b operating with different collector currents, or two transistors a and b of different areas but otherwise identical and operating with equal collector currents, there results:

$$V_{BEa} - V_{BEb} = \frac{KT}{q}\ln\left(\frac{J_{Qa}}{J_{CO}}\right) - \frac{KT}{q}\ln\left(\frac{J_{Qb}}{J_{CO}}\right)$$

or:

$$V_{BEa} - V_{BEb} = \frac{KT}{q}\ln\left(\frac{J_{Qa}}{J_{Qb}}\right)$$

Where: $J_{Qa}$ and $J_{Qb}$ are the current densities in transistors a and b, respectively Thus, the difference in the VBEs of the two transistors operating with different current densities is proportional to absolute temperature (PTAT).

Various references that use the foregoing principle to provide an output proportional to absolute temperature are well known. However the output of such references also has an undesired dependence on the inputs to the references. Since such references are frequently used as sources for bias currents in linear circuits, this dependence can increase noise and create other undesired effects in the circuits in which they are used.

BRIEF SUMMARY OF THE INVENTION

Proportional to absolute temperature references having reduced input sensitivity are disclosed. The references utilize four bipolar transistors, at least one of which is of a different size, coupled to a resistor in a loop, whereby the difference in the VBEs of the transistors appears as a voltage across the resistor. The addition of a further resistor of a selected size in the base circuit of one of the four transistors provides an input variation of an opposite sign to that caused by the finite base currents of the transistors, thereby substantially reducing the input voltage (current) dependence of the proportional to absolute temperature references. Various embodiments are disclosed.

DETAILED DESCRIPTION OF THE PREFERRED EMBODIMENT

Figure 1:
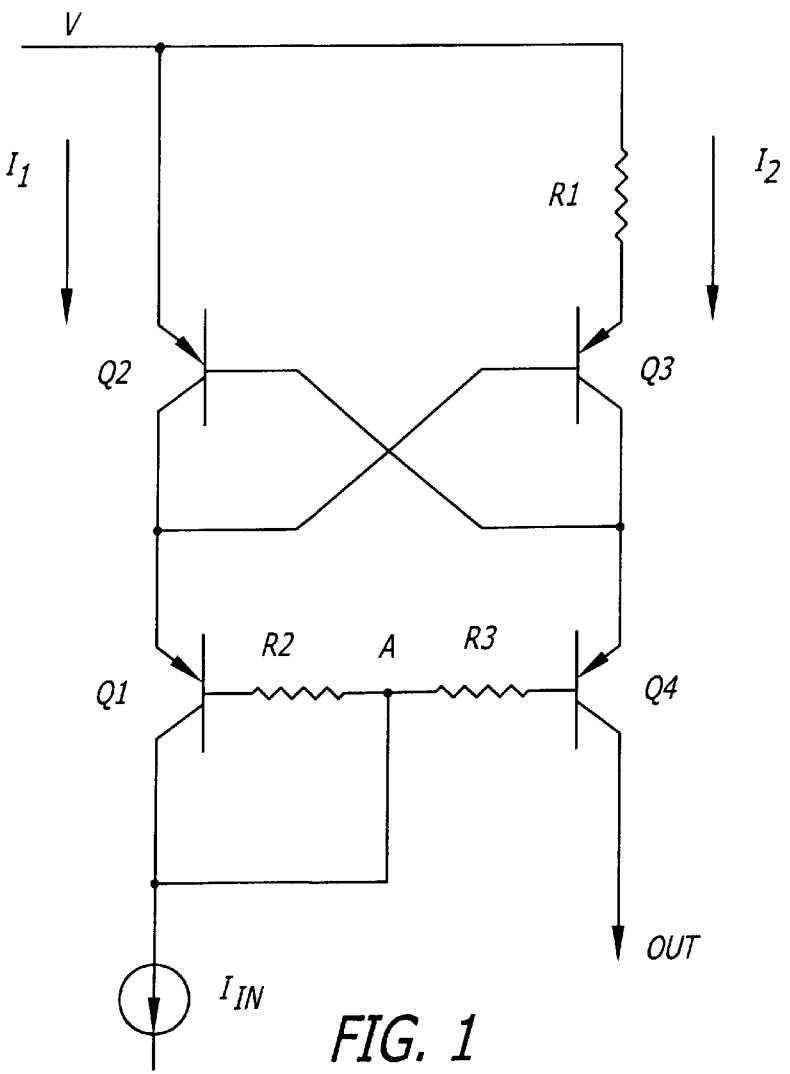
FIG. 1 is a circuit diagram for an exemplary preferred embodiment of the present invention.

Referring now to FIG. 1, a preferred embodiment of the present invention may be seen. In this embodiment, transistors Q1 and Q3 are A times as large as transistors Q2 and Q4. Assuming base currents are zero, there will be no voltage drop across resistors R2 or R3, so that the circuit may be redrawn as in FIG. 2. With zero base currents, the current in transistor Q2 will be the same as the current in transistor Q1 (I1), and the current in transistor Q3 will be the same as the current in transistor Q4 (I2). The zero base current assumption also means that the base voltages of transistors Q1 and Q4 will be equal. Therefore:

$$(I_2 \star R_1) + VBE3 + VBE1 = VBE2 + VBE4$$

Or:

$$(I_2 \star R_1) = (VBE2 - VBE1) + (VBE4 - VBE3) \quad \text{Eq. 1}$$

Because transistors Q1 and Q3 are A times as large as transistors Q2 and Q4, transistors Q1 and Q2 have equal collector current, and transistors Q3 and Q4 have equal collector current:

$$VBE2 - VBE1 = \frac{KT}{q}\ln(A)$$

$$VBE4 - VBE3 = \frac{KT}{q}\ln(A)$$

Therefore:

$$I_2 = \frac{KT}{qR_1}\ln(A^2)$$

Thus the output current is proportional to absolute temperature, independent of the input current $I_1$. Since the voltage between the input voltage IN and V is only VBE1+VBE2, typically a current source is coupled to the collector of transistor Q1 to provide the input current thereto from a power supply substantially exceeding VBE1+VBE2, though other means for providing current to the PTAT reference may be used if desired. The current source may, by way of example, be a resistor or an active current source as are well known in the art.

In practice however, transistor base currents are not zero, as transistor betas (transistor current gain) in integrated circuits may be as low as 20 to 30, or lower. Referring again to FIG. 2, with finite betas, the currents in transistors Q3 and Q4 will still be approximately proportional to absolute temperature, so that at any specific temperature, the base currents of transistors Q3 and Q4 will be substantially fixed. However, the currents in transistors Q2 and Q1 will vary with variations of the input power supply. By way of specific example, if the input terminal IN is connected through a resistive current source R4 to the power supply ground terminal (an active current source would be substantially better, but the following illustrates the point), the current in transistor Q1 will be approximately equal to:

$$I_{Q1} = \frac{V - V_{BE2} - V_{BE4}}{R4} \qquad \text{Eq. 2}$$

where: $I_{Q1}$ is a collector current in transistor Q1 $V_{BE1}$ is the base emitter voltage in transistor Q1 $V_{BE\,3}$ is the base emitter voltage in transistor Q3

Since $V_{BE2}$ and $V_{BE4}$ are approximately independent of the input voltage V, the current $I_{Q1}$ through transistor Q1 and therefore the current $I_{Q2}$ through transistor Q2 will vary substantially with variations in the power supply voltage V, such as may be caused by noise on the power supply line. The variation in current in transistor Q2 with supply voltage or current will cause a corresponding variation in the base current of transistor Q2. Consequently, not only are the currents in transistors Q3 and Q4 not equal because of the finite beta of the transistors, particularly transistor Q2, but in addition the difference in currents between transistors Q3 and Q4 has a substantial power supply input dependence. Consequently, referring back to Eq. 1 ($(I_2 \bigstar R_1)$ =(VBE2−VBE1)+(VBE4−VBE3)), an increase in the current in transistor Q2 will increase its base current. This adds an increased component of current through transistor Q4 that is not passing through transistor Q3, increasing VBE4−VBE3 responsive to the increased power supply input. This in turn increases the current through resistor R1 (see Eq. 1). Since the base current of transistor Q3 doesn't change much at a fixed temperature, the increase in the current through resistor R1 together with the increase in the base current of transistor Q2, almost all of which increases flow through transistor Q4, results in a substantial increase in the PTAT output current with an increase in the supply voltage (current in transistors Q1 and Q2).

Figure 3:
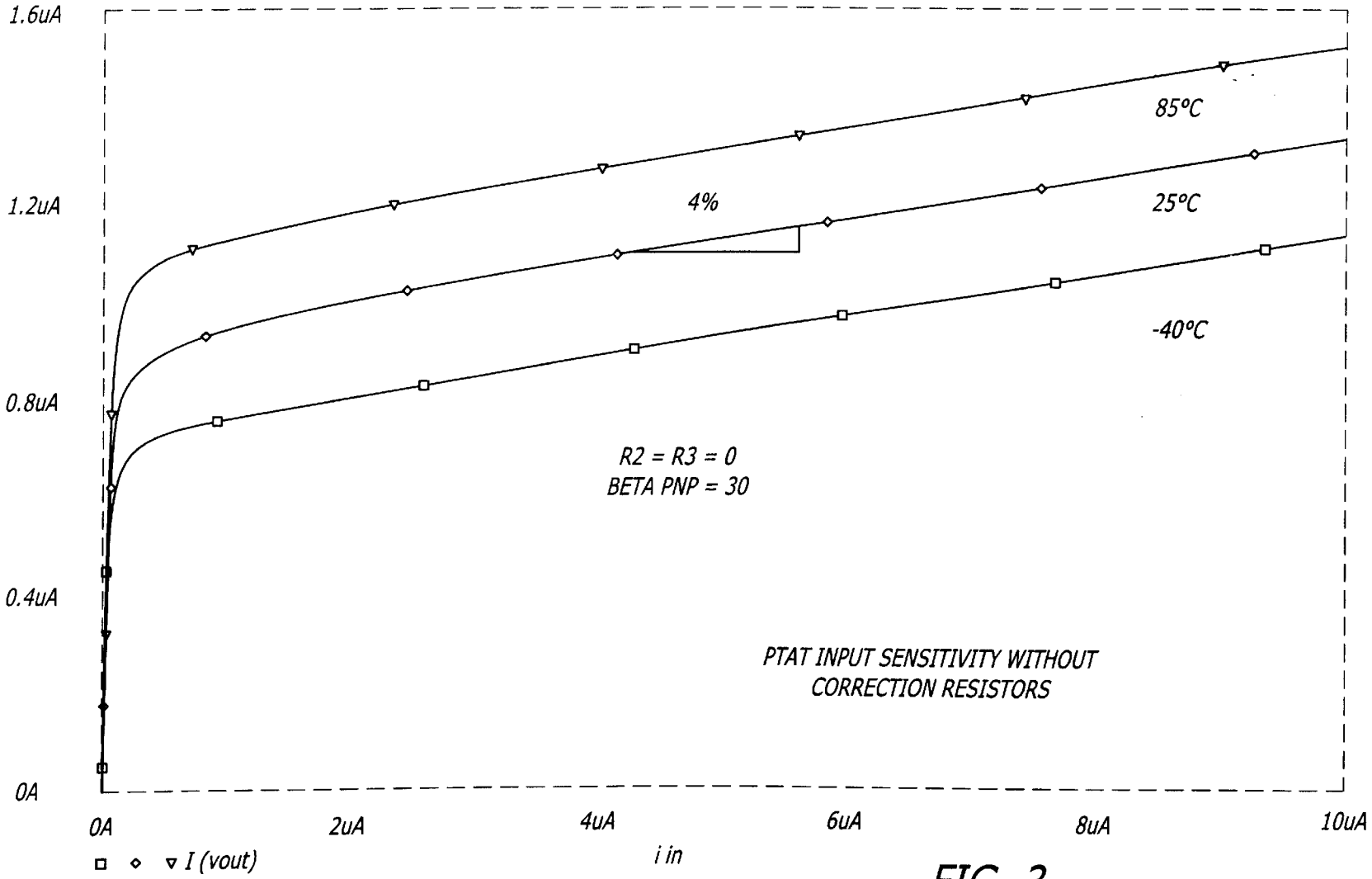
FIG. 3 is a graph for a prior art PTAT current source showing a typical variation in output current with temperature, and the variation in the output current with input current applied to the IN terminal for three different temperatures, the graph determined by simulation and assuming a value of β=30 for the transistors.

Consequently, the output current on the OUT terminal will have a substantial power supply dependence in addition to its first order variation proportional to absolute temperature. A typical variation with supply current determined by simulation may be seen in FIG. 3, assuming a value of β for the transistors of 30. That Figure shows the variation in the output current with input current applied to the IN terminal for three different temperatures. As may be seen therein, for any specific input current, the output current exhibits the expected proportionality with absolute temperature, though also exhibits a variation with input current, in that example approximately 4% per microAmp input.

In accordance with the present invention, resistors R2 and R3 (R3 being optional) are added to the base circuits of transistors Q1 and Q4 so that the base currents of the pnp transistors Q1 and Q4 will raise the base voltages of those transistors above the voltage of node A in an amount dependent upon the magnitude of those base currents. Now:

$$(I_2 \bigstar R_1)+VBE3+VBE1+I_{bQ1} \bigstar R2=VBE2+VBE4+I_{bQ4} \bigstar R3$$

where: $I_{bQ1}$ is the base current of transistor Q1 $I_{bQ4}$ is the base current of transistor Q4

Or:

$$(I_2 \bigstar R_1)=(VBE2-VBE1)+(VBE4-VBE3)+(I_{bQ4} \bigstar R3)-(I_{bQ1} \bigstar R2) \qquad \text{Eq. 3}$$

Note that in the above equations, the change in base current $I_{bQ1}$ of transistor Q1 will be approximately proportional to the change in the input current (Eq. 2), whereas the base current $I_{bQ3}$ of transistor Q3 and the base current $I_{bQ4}$ of transistor Q4 will both be approximately constant at any given temperature. The betas of transistors Q1 and Q2 will tend to match, so that the base current $I_{bQ1}$ of transistor Q1 will be a good approximation of the base current $I_{bQ2}$ of transistor Q2. Consequently, the presence of resistor R2 provides a negative term that, by properly selecting the value of the resistor, can be used to offset the increase in the current $I_{bQ2}$ with an increase in input current previously discussed, and even compensate for the effect of the change in VBE4−VBE3 in the above equation due to the base current of transistor Q2 (which also varies with input current) flowing through transistor Q4 and not transistor Q3.

As stated before, the resistor R3 is optional. If used, it may be chosen so that under some nominal conditions, the voltage drop across resistor R3 will equal the voltage drop across resistor R2, so that these voltage drops cancel in the loop equation (Eq. 3) set forth above. Under these conditions, the output current is determined only by the voltage drop across resistor R1.

Figure 4:
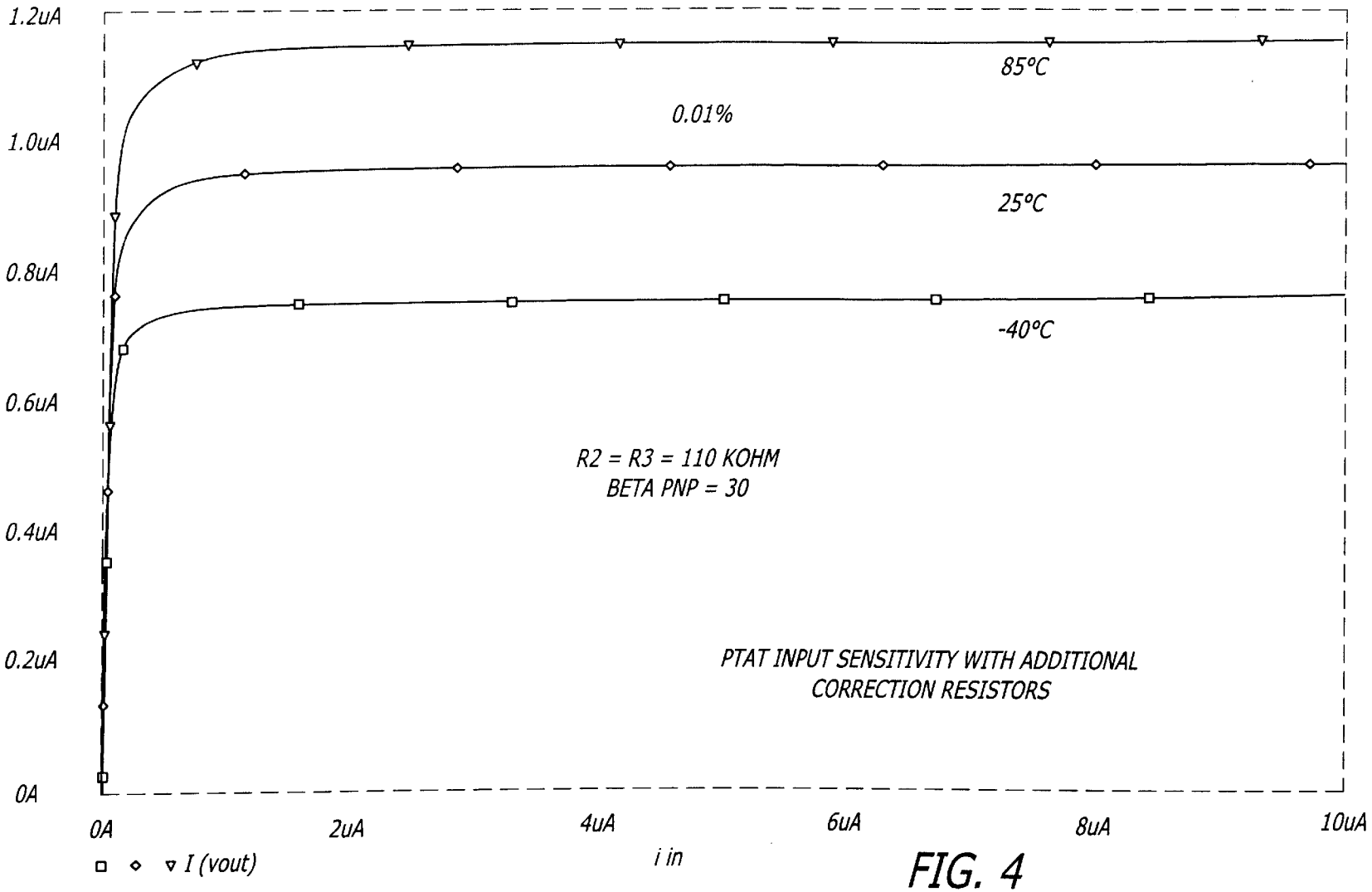
FIG. 4 is a graph for a PTAT current source in accordance with the present invention showing a typical variation in output current with temperature, and the variation in the output current with input current applied to the IN terminal for three different temperatures, the graph determined by simulation and assuming a value of β=30 for the transistors.

FIG. 4 is a graph for a PTAT current source in accordance with the present invention showing a typical variation in output current with temperature, and the variation in the output current with input current applied to the IN terminal for three different temperatures, the graph determined by simulation and assuming a value of β=30 for the transistors. This is to be compared to FIG. 3, the variation in output current with input current in FIG. 3 being 4% (0.04 microAmps per microAmp), and that of FIG. 4 being 0.01% (0.0001 microAmps per microAmp).

Figure 2:
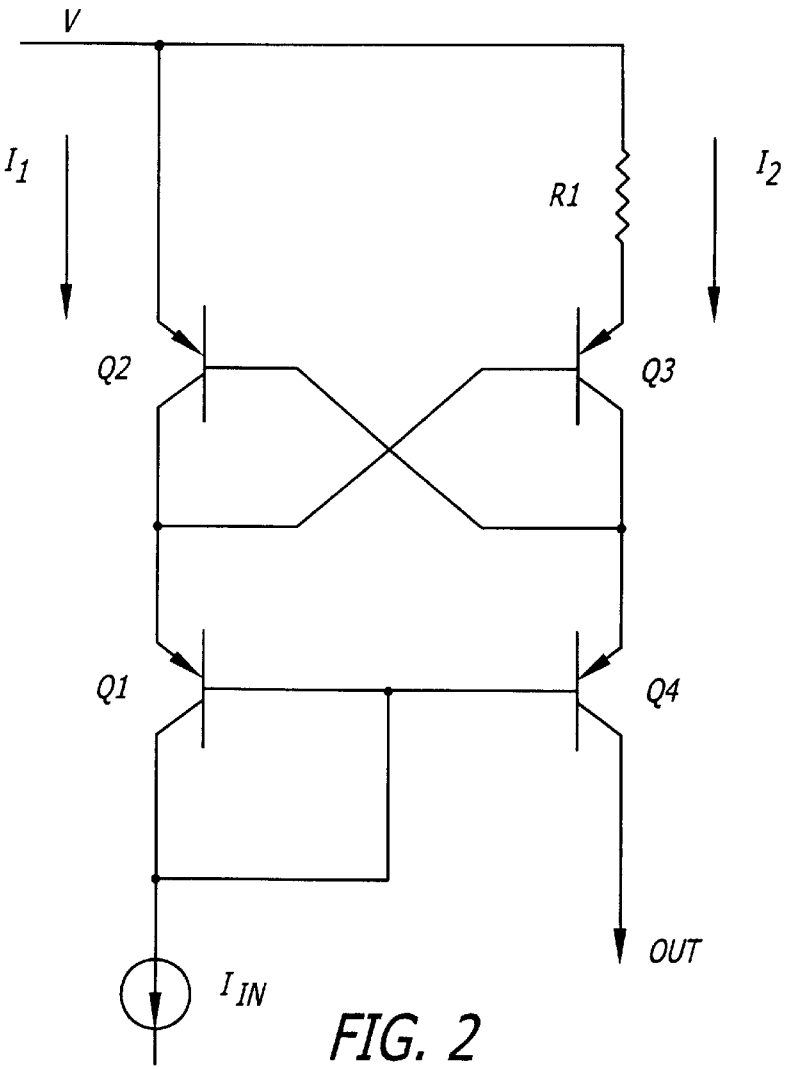
FIG. 2 is an equivalent circuit diagram for the exemplary embodiment of FIG. 1 assuming zero base currents.

In the embodiment described with respect to FIGS. 1 and 2, pnp-transistors were used wherein transistors Q1 and Q3 are A times as large as transistors Q2 and Q4. It should be noted, however, that while this is a convenient relationship in transistor sizes, it is not essential that transistors Q1 and Q3 be of the same size or that transistors Q2 and Q4 be of the same size. It is only necessary that the transistor sizes be selected so that the right-hand side of equation 1 provides a positive voltage, causing the positive current through resistor R1. In that regard, in an exemplary alternate embodiment, transistors Q1 and Q2 are the same size to cause their betas to better match. Further, the same principle of the present invention applies to the realization of PTAT sources by circuits utilizing npn transistors. Thus, the present invention applies to any four junction transistor loops, whether of npn transistors or pnp transistors, wherein the difference in the VBEs of the transistors around the loop equals the voltage across a resistor setting the output current.

Thus a PTAT current source having a reduced sensitivity to variations in the PTAT reference input current has been disclosed comprising a PTAT reference having a plurality of bipolar transistors coupled to a PTAT reference input current and providing a PTAT output current, and circuitry (in the exemplary embodiment, a resistor in a transistor base circuit) contributing to the PTAT output current and responsive to variations in the PTAT reference input current to reduce the sensitivity of the PTAT reference to variations in the PTAT reference input current. The method of reducing the dependence of the output of a PTAT reference on a PTAT reference supply current due to transistor base currents comprises providing a PTAT reference having a plurality of bipolar transistors coupled to a PTAT reference input current and providing a PTAT output current, and generating a component of PTAT output current responsive to variations in the PTAT reference input current (in the exemplary embodiment, generated responsive to the base current of at least one of the bipolar transistors) to reduce the sensitivity of the PTAT reference to variations in the PTAT reference input current.

While the present invention has been disclosed with respect to its use as a current biasing circuit for other circuits, it may be used for many other purposes as desired, including as a voltage reference proportional to absolute temperature. Therefore the disclosure herein should be taken as an explanation of certain exemplary embodiments and not for purposes of limitation. Thus, while certain preferred embodiments of the present invention have been disclosed and described herein, it will be understood by those skilled in the art that various changes in form and detail may be made therein without departing from the spirit and scope of the invention.

What is claimed is:

1. A PTAT reference comprising:

first, second, third and fourth transistors, each having an emitter, a base and a collector for conducting current through the respective transistor between its emitter and its collector, the base emitter voltage of each transistor being responsive to the collector current in the respective transistor, the base currents of the transistors being non-zero when the transistors are conducting;

an input current;

the first transistor having its base coupled through a first resistor to the collector of the first transistor and through the first resistor to the base of the fourth transistor;

the emitter of the first transistor being coupled to the base of the third transistor and to the collector of the second transistor;

the third transistor having its emitter coupled through a second resistor to the emitter of the second transistor and its collector coupled to the emitter of the fourth transistor and to the base of the second transistor;

the input current being coupled to supply current through the first and second transistors, and the second resistor and the third and fourth transistors;

at least one of the transistors being a different size from the other transistors so that a voltage across the second resistor is responsive to the difference in base emitter voltages of the second and fourth transistors and the first and third transistors;

the first resistor being selected to reduce the variation in the current in the collector of the fourth transistor with variations in the current provided by the input current.

2. The PTAT reference of claim 1 wherein the base of the first transistor is coupled to the base of the fourth transistor through the first resistor and a third resistor.

3. The PTAT reference of claim 2 wherein the resistance of the third resistor is selected to provide the same voltage drop as the first resistor under nominal operating conditions.

4. A method of reducing the dependence of the output of a PTAT reference on PTAT reference input current comprising:

providing first, second, third and fourth transistors, each having an emitter, a base and a collector for conducting current through the respective transistor between its emitter and its collector, the base emitter voltage of each transistor being responsive to the collector current in the transistor, the base currents of the transistors being non-zero when the transistors are conducting; coupling the base of the first transistor to the collector of the first transistor through a first resistor and coupling the base of the first transistor through the first resistor to the base of the fourth transistor;

coupling the emitter of the first transistor to the base of the third transistor and to the collector of the second transistor;

coupling the emitter of the third transistor through a second resistor to the emitter of the second transistor and coupling the collector of the third transistor to the emitter of the fourth transistor and to the base of the second transistor;

at least one of the transistors being a different size from the other transistors so that a voltage across the second resistor is responsive to the difference in base emitter voltages of the second and fourth transistors and the first and third transistors;

passing a current through the first and second transistors, and the first resistor and the third and fourth transistors;

the first resistor being selected to reduce the variation in the current in the collector of the fourth transistor with variations in the current through the first and second transistors.

5. The method of claim 4 wherein the base of the first transistor is coupled to the base of the fourth transistor through the first resistor and a third resistor.

6. The method of claim 5 wherein the resistance of the third resistor is selected to provide the same voltage drop as the first resistor under nominal operating conditions.

* * * * *